US007237686B2

(12) United States Patent
Bertrand et al.

(10) Patent No.: US 7,237,686 B2
(45) Date of Patent: Jul. 3, 2007

(54) SPICE RACK

(76) Inventors: Richard L. Bertrand, 219 Mattapoisett Rd., Rochester, MA (US) 02770; Denise C. Bertrand, 219 Mattapoisett Rd., Rochester, MA (US) 02770

( * ) Notice: Subject to any disclaimer, the term of this patent is extended or adjusted under 35 U.S.C. 154(b) by 91 days.

(21) Appl. No.: 11/059,541

(22) Filed: Feb. 17, 2005

(65) Prior Publication Data

US 2005/0247843 A1 Nov. 10, 2005

Related U.S. Application Data

(60) Provisional application No. 60/568,735, filed on May 7, 2004.

(51) Int. Cl.
*A47B 73/00* (2006.01)

(52) U.S. Cl. ..... 211/74; 211/126.15; 312/9.3; 312/132

(58) Field of Classification Search ..... 211/74, 211/126.14, 59.4, 59.1, 59.2, 162; D7/624.1; 312/246, 9.3, 131, 132; 248/298.1; 206/558; 108/143; 221/99

See application file for complete search history.

(56) References Cited

U.S. PATENT DOCUMENTS 827,649 A 7/1906 Murphy
3,664,719 A * 5/1972 Berg ..... 312/185
4,019,638 A * 4/1977 Miller ..... 211/74
4,650,077 A * 3/1987 Droz ..... 206/566
4,714,305 A 12/1987 Service
5,119,947 A * 6/1992 Stewart ..... 211/41.2
5,671,987 A 9/1997 Hommes
5,720,547 A 2/1998 Baird
D406,218 S 3/1999 Schneider
6,227,386 B1 * 5/2001 Close ..... 211/59.3
D465,891 S * 11/2002 Brown ..... D32/55
6,497,323 B2 * 12/2002 Lewis ..... 206/575
6,601,714 B2 * 8/2003 Bladek ..... 211/85.2
6,705,475 B2 * 3/2004 Geiger ..... 211/86.01
2004/0007548 A1 1/2004 Tilly

* cited by examiner

*Primary Examiner*—Richard E. Chilcot, Jr.
*Assistant Examiner*—Jared W. Newton
(74) *Attorney, Agent, or Firm*—Richard C. Litman

(57) ABSTRACT

A spice rack including an array of sliding drawers positioned on a base. The assembly will be placed on an existing kitchen cabinet shelf. It should be noted however, that the assembly may be made to replace the existing shelf if desired. The assembly is designed to store spice containers in a relative small space, which containers may be easily identified and retrieved. Each drawer includes a planar, horizontal bottom surface having a knob secured to the front end. Plural dowels are positioned along each side of the planar surface to define an enclosed area for the spice containers.

5 Claims, 4 Drawing Sheets

SPICE RACK

CROSS-REFERENCE TO RELATED APPLICATION

This application claims the benefit of U.S. Provisional Patent Application Ser. No. 60/568,735, filed May 7, 2004.

BACKGROUND OF THE INVENTION

1. Field of the Invention

The present invention generally relates to kitchen accessories. More specifically, the present invention is drawn to a spice rack.

2. Description of the Related Art

"I can't find the sage!!" That, and similar laments are uttered daily as food preparers search through cluttered cabinets seeking the necessary spices that will make the meal a success. Aside from delaying and sometimes ruining the food preparation process, the search efforts can cause immeasurable frustration. What a boon it would be if all the spices were located in one convenient place in an ordered, easily retrievable array.

There are many devices that address the organization of the spice pantry. Exemplary ones of these devices are cited in the IDS. Some of the cited devices are merely drawn to ornamental designs. Others require structural modification of a kitchen cabinet for installation. Still others do not display the spice containers in a manner to be readily identified when desired.

None of the above inventions and patents, taken either singly or in combination, is seen to disclose an array of sliding spice drawers for mounting on a kitchen cabinet shelf or the like as will be subsequently described and claimed in the instant invention.

SUMMARY OF THE INVENTION

The instant invention is an assembly comprising an array of sliding drawers positioned on a base. As contemplated, the assembly will be placed on an existing kitchen cabinet shelf. It should be noted however, that the assembly may be made to replace the existing shelf if desired. The assembly is drawer includes a planar, horizontal bottom surface having a knob secured to the front end. Plural dowels are positioned along the sides of the planar surface to define an enclosed space for the spice containers.

The drawers are self-supporting and include a groove on each side. Each groove engages a key, which key is attached to the base. The drawers may be disengaged from the keys by simply pulling the drawer all the way out. The drawers are two inches wide thus, the assembly is easily adapted to six, eight, ten, twelve or fourteen inch cabinets. The base, drawers, dowels, knobs and keys can be fabricated from any suitable materials or combinations thereof (wood, metal, plastic). Although designated as a spice rack, it is obvious that the assembly could be utilized as a solution for other storage problems.

Accordingly, the assembly offers a solution for organizing an array of containers or the like for easy identification and retrieval. The dimensions are such that the assembly is easily adaptable to conventional, standard-size cabinets. The invention provides for improved elements and arrangements thereof for the purposes described which are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
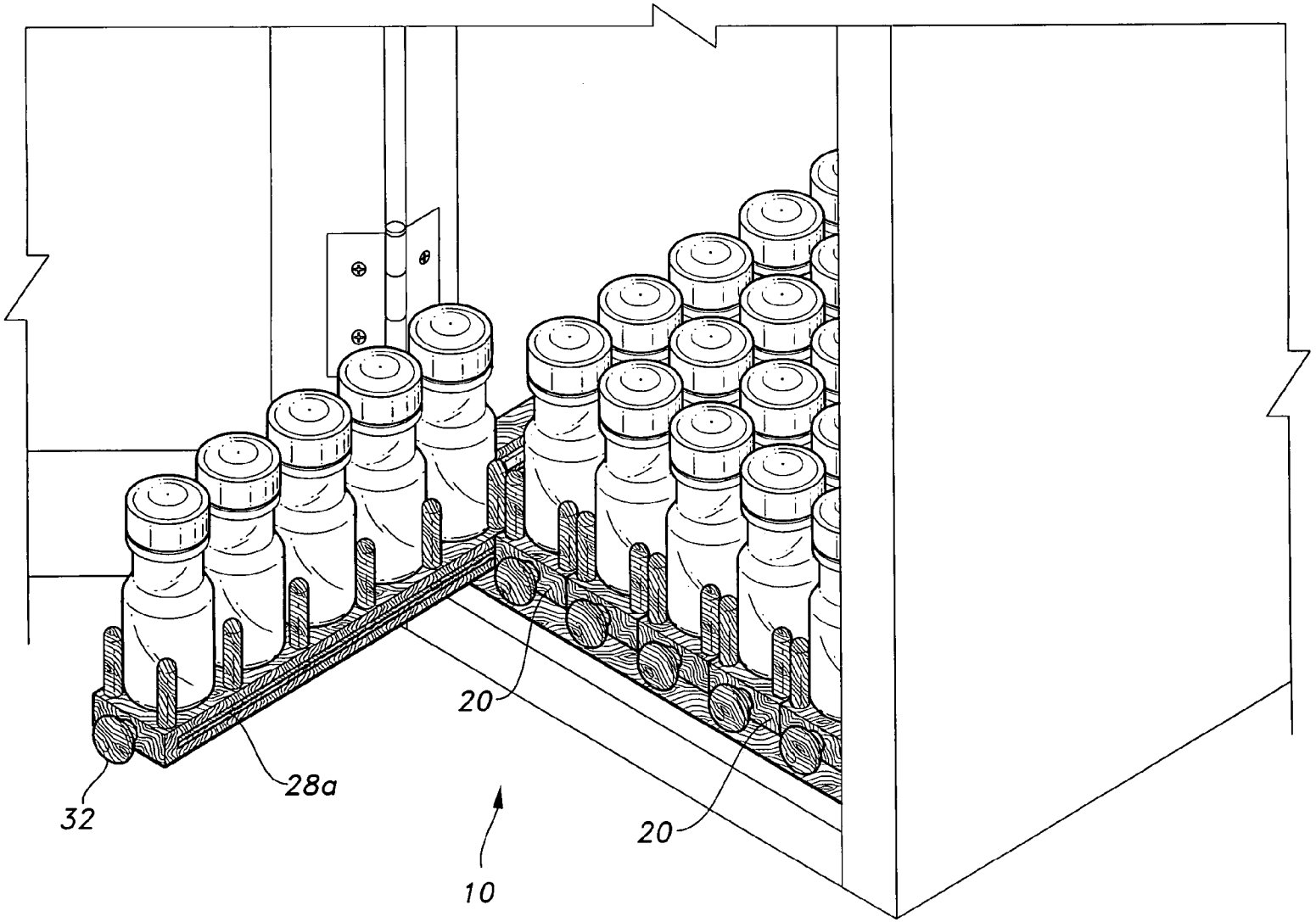
FIG. 1 is an environmental, perspective view of a spice storage assembly according to the present invention.
Figure 2:
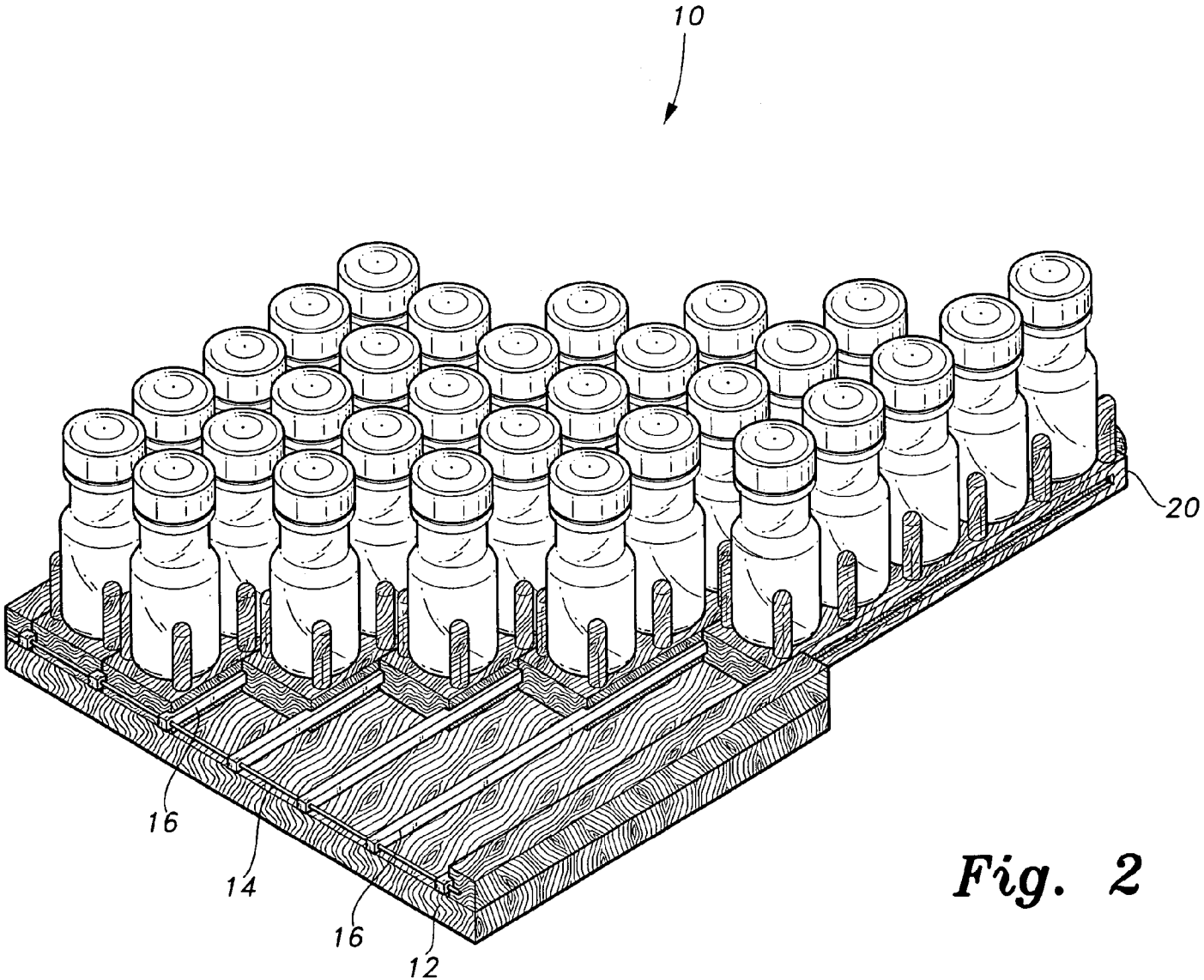
FIG. 2 is a perspective rear view of a spice storage assembly according to the present invention.

Attention is first directed to FIGS. 1 and 2 wherein the spice storage assembly of the present invention is generally indicated at 10. Assembly 10 comprises a base 12 preferably of rectangular configuration. Base 12 has a length of at least ten and one-fourth inches to accommodate the sliding drawers described below. Base 12 will be made in various widths to fit conventional cabinet widths as stated above. A stop member 14 is attached to the rear upper surface of base 12 and is coextensive with the width of base 12. A series of key members 16 extend from the rear end to the front end of base 12, which key members are perpendicular to stop member 14. As contemplated, base 12 will be positioned on the bottom shelf of a cabinet. However, the base could replace the bottom shelf of the cabinet if desired.

Figure 3:
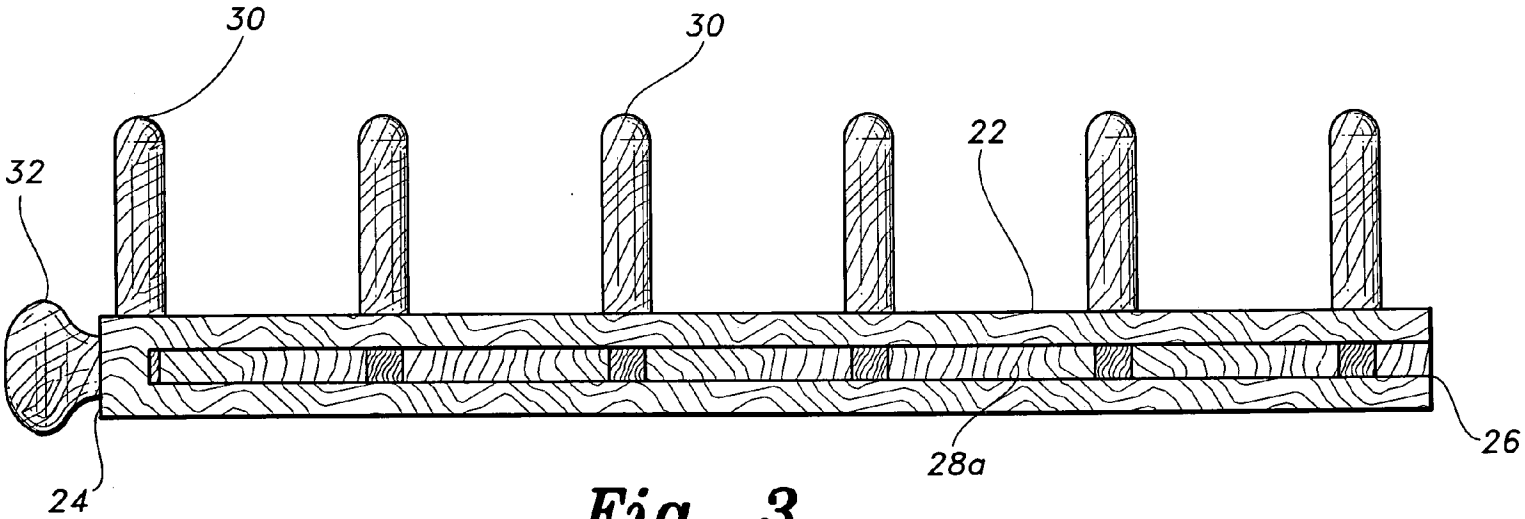
FIG. 3 is a side view of a sliding drawer a spice storage assembly according to the present invention.
Figure 4:
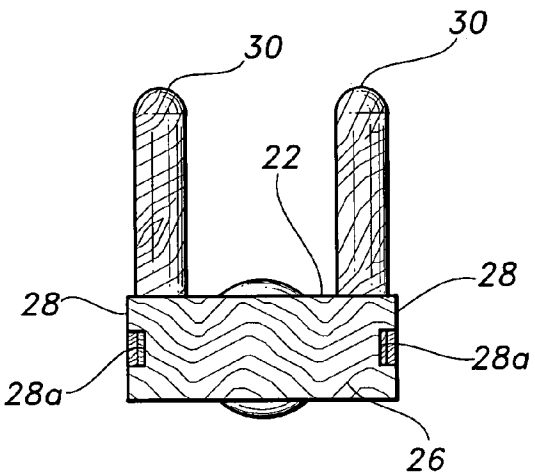
FIG. 4 is a rear view of a sliding drawer a spice storage assembly according to the present invention.

An array of drawers 20 is adapted to be slidably supported on base 12. As best seen in FIGS. 3 and 4, each drawer 20 comprises a rectangularly configured body having an upper surface 22, front end 24, rear end 26 and sides 28. Each drawer has a length of approximately ten and one-fourth inches and a width of approximately two inches. Each side 28 has a groove 28*a* formed therein, which groove is dimensioned to receives a key member 16 therein. A plurality of dowels 30 is positioned along each side of each drawer 20 and extends vertically from the upper surface 22. Each dowel has a length of approximately two inches and an outside diameter of approximately three-eighths of an inch. The dowels are placed on surface 22 to enclose an area for supporting spice containers or the like. The dowels will prevent the containers from toppling. The open structure of the drawer permits a user to easily identify a particular spice container when the drawer is extended as in FIG. 1. A knob 32 is attached to the front end 24 to enhance drawer manipulation. Although the spice containers are of like size as illustrated, it should be noted that containers of different sizes and configurations may be easily accommodated.

Figure 5:
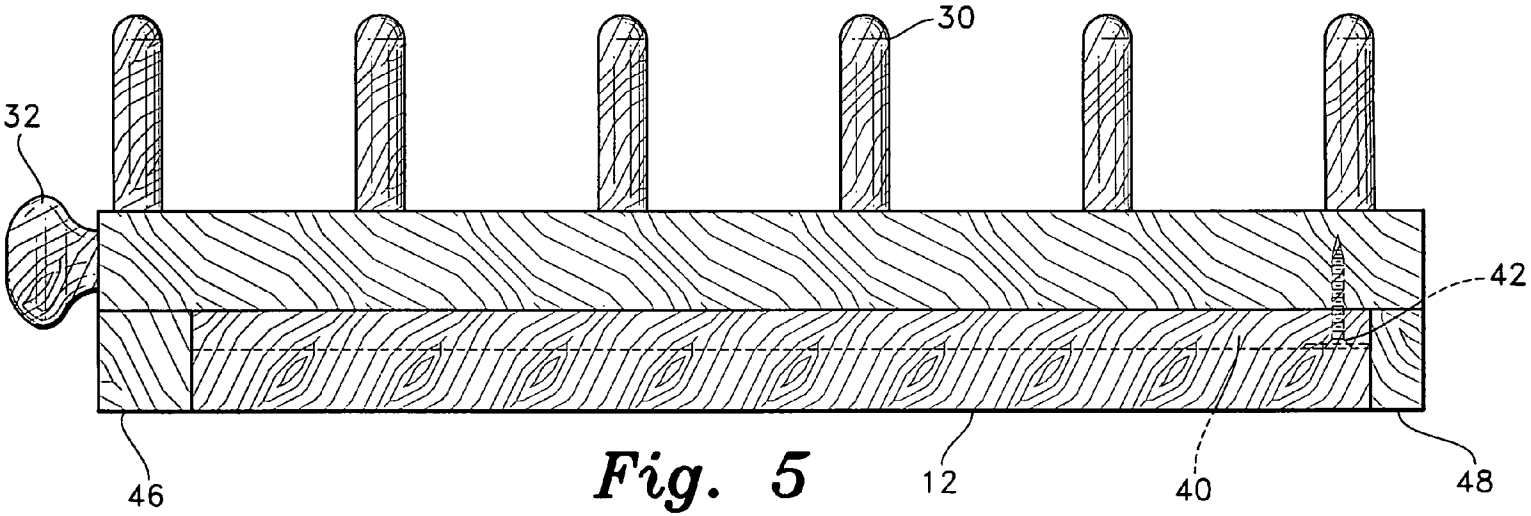
FIG. 5 is a side view of a second embodiment of a sliding drawer a spice storage assembly according to the present invention.
Figure 6:
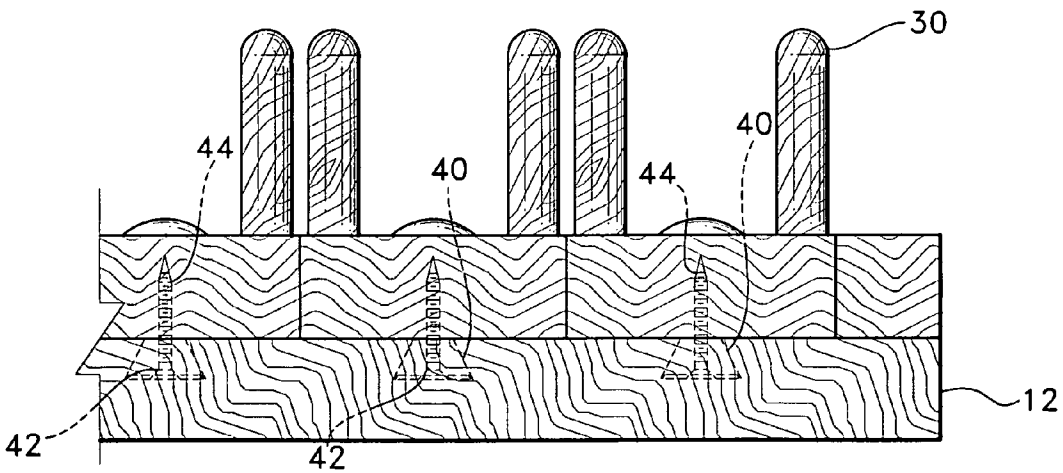
FIG. 6 is a partial end view of a second embodiment of a sliding drawer a spice storage assembly according to the present invention.

An alternative arrangement is shown in FIGS. 5 and 6 wherein a series of dovetail grooves 40 are formed in the upper surface of base member 12. Grooves 40 extend the length of the base member 12. Respective slide engagement members 42 have distal ends 44 threaded into the bottom surface of each drawer. The proximate end of each member is a tapered washer, which washer is dimensioned to fit and slide in a respective groove 40. Stop members 46 and 48 extend across the front and rear of base 12 to prevent the drawer from being disengaged from the It is to be understood that the present invention is not limited to the embodiments described above, but encompasses any and all embodiments within the scope of the following claims.

We claim:

1. A spice storage assembly, comprising:

a base, said base having an upper surface, a front end, a rear end, a length and a width;

a stop member attached to said base at said rear end, said stop member extending across said rear end and coextensive with said width of said base;

a series of key members, each key member attached to said base and extending from said front end to said rear end and coextensive with the length of said base said key members being spaced apart in parallel relationship; and an array of drawers disposed on said base member, each drawer of the array being in sliding engagement with a pair of key members, wherein each drawer has a length, a first side, a second side parallel with said first side and a planar upper surface extending from said first side to said second side, said first side and said second side being coextensive with the length of the drawer, each said first side and said second side including a groove, wherein said each groove is in sliding engagement with a respective key of said pair of key members;

a first plurality of dowels extending upwardly from said planar upper surface and aligned along said first side of each drawer; and a second plurality of dowels extending upwardly from said planar upper surface and aligned along said second side of each drawer.

2. The spice storage assembly according to claim 1, wherein each drawer of the array has a front end and wherein a knob is attached to each said front end.

3. A spice storage assembly, comprising:

a base, said base having an upper surface, a front end, a rear end, a length and a width;

a stop member attached to said base at said rear end, said stop member extending across said rear end and coextensive with said width of said base;

a stop member attached to said base at said front end, said stop member extending across said front end and coextensive with said width of said base;

a series of grooves formed in said base, each groove extending from said front end to said rear end and coextensive with the length of said base;

an array of drawers, wherein each drawer of said array has an undersurface disposed on said base; a first side, a second side parallel with said first side and a planar upper surface extending from said first side to said second side;

a slide engagement member attached to each said undersurface for sliding engagement in a respective groove a first plurality of dowels extending upwardly from said planar upper surface and aligned along said first side of each drawer; and a second plurality of dowels extending upwardly from said planar upper surface and aligned along said second side of each drawer.

4. The spice storage assembly according to claim 3, wherein said slide engagement member is a tapered washer.

5. The spice storage assembly according to claim 3, wherein each drawer of the array has a front end and wherein a knob is attached to each said front end.

* * * * *